United States Patent [19]

Funger et al.

[11] Patent Number: 4,576,112

[45] Date of Patent: Mar. 18, 1986

[54] DEVICE FOR APPLYING A TREATMENT MEDIUM, ESPECIALLY IN FOAM FORM, TO A RUNNING WEB OF MATERIAL

[75] Inventors: Bernhard Funger, Krefeld; Heinz Grüber, Tonisvorst; Werner Hartmann, Krefeld; Julius Kohnen; Johannes Kütz, both of Tonisvorst; Manfred Moser, Krefeld-Fischeln, all of Fed. Rep. of Germany

[73] Assignee: Eduard Küsters, Krefeld-Forstwald, Fed. Rep. of Germany

[21] Appl. No.: 602,677

[22] Filed: Apr. 23, 1984

[30] Foreign Application Priority Data

Apr. 30, 1983 [DE] Fed. Rep. of Germany ..... 3315770

[51] Int. Cl.[4] ..... B05C 3/02

[52] U.S. Cl. ..... 118/415; 118/412; 68/200

[58] Field of Search ..... 118/410, 411, 412, 415; 68/200, 205 R; 101/119, 120; 427/373

[56] References Cited

U.S. PATENT DOCUMENTS

| | | | |
|---|---|---|---|
| 3,587,458 | 6/1971 | Riednolz et al. | 101/114 |
| 3,969,780 | 7/1976 | Henderson | 8/149.1 |
| 4,061,001 | 12/1977 | von der Eltz et al. | 68/200 |
| 4,497,249 | 2/1985 | Mitter | 101/120 |

FOREIGN PATENT DOCUMENTS 3030233 2/1982 Fed. Rep. of Germany .

*Primary Examiner*—John D. Smith
*Assistant Examiner*—K. Jaconetty
*Attorney, Agent, or Firm*—Kenyon & Kenyon

[57] ABSTRACT

A device for applying a treatment medium, especially in foam form, to a running web of material, especially a rug web, with an application beam extending transversely to the web of material, the application beam having a longitudinal slot, through which the treatment medium emerges onto the web of material. On the side opposite the slot an elastic cushion which presses the web of material against the sliding surface of the application beam is arranged on the back of the web of material. The cushion may be an inflatable elastic hollow body or a foam material cushion.

33 Claims, 2 Drawing Figures

DEVICE FOR APPLYING A TREATMENT MEDIUM, ESPECIALLY IN FOAM FORM, TO A RUNNING WEB OF MATERIAL

BACKGROUND OF THE INVENTION

This invention relates to devices for applying treatment media in general and more particularly to an improved applicator particularly useful in applying foam.

A device for applying a treatment medium, especially in form form, to a running web of material, especially a rug web, with an application beam which extends transversely to the web of material and parallel to its surface is known. The beam rests with a sliding surface against the surface of the web of material and contains an inner chamber extending over its length into which feed lines for the treatment medium lead. The beam opens onto the sliding surface through a slot extending along the application beam. A support is arranged opposite the slot on the other side of the web of material for the web of material travelling past the slot.

Such an arrangement does not provide sufficient uniformity on the treatment medium application. Due to the fact that the support is permeable and, in addition, a suction pull is active, the treatment medium, because of local irregularities of the web material which are always present, can pass through the web. As a result the remaining loading of the web of material with the treatment medium is nonuniform, so that shaded dyeing rejects can be produced if, for instance, dyeing foam is involved.

It is an object of the present invention to provide a device of the general type described above in which a more uniform foam application is possible at low cost.

SUMMARY OF THE INVENTION

According to the present invention, this problem is solved with a support formed by a cushion with a closed surface which extends over the length and width of the slot, covers the edge of the slot, is elastically resilient at least perpendicular to the sliding surface but is overall stationary and presses the web of material against the sliding surface in the vicinity of the slot.

Through the use of the cushion with its closed surface, the treatment medium can no longer pass through the web of material and the support, but remains in the web of material in the amount which has emerged from the slot. The cushion fulfills a sealing function around the slot so that treatment medium also cannot emerge parallel to the web of material between the web and the sliding surface. Instead, the treatment medium always remains in the region of the web of material, into which it is to be applied. With the device according to the present invention, the web of material is charged in all surface regions, independently of locally different permeability which may be present, automatically and exactly with the precalculated amount of treatment medium. The cushion rests against the web of material with gentle pressure in the region of the sliding surface, so that sliding at the cushion and the sliding surfaces is not impeded. The resiliency of the cushion ensures a largely uniform contact in the region of the edge of the slot.

In the preferred embodiment, the cushion can be designed as an inflatable hollow body with elastically resilient walls and can be filled with a fluid medium under selectable pressure. In practice, pressures on the order of 0.1 bar are considered for the inflation.

Foam material cushions can also be used. The contact of the web of material takes place on a crowned sliding surface of the application beam, which may be advisable, because then the web of material, even without the cushion, rests against the sliding surface with a certain uniform pressure perpendicular to the sliding surface. It is advisable that the contact area of the web of material at the sliding surface be at least as large as the contact area of the cushion against the web of material. This means that the contact conditions at the application beam are not to be changed by the action of the cushion.

The application beam may consist of a segment of a thick-walled tube. This is particularly advantageous if the application beam is to consist of plastic. It is then produced in a simple manner by cutting up a centrifugally cast plastic tube lengthwise.

An important embodiment of the present invention is one in which a sliding foil is arranged between the cushion and the web of material. The foil covers the entire contact area of the cushion at the web of material, has a closed surface and is held at its rear edge, relative to the direction of motion of the web of material, at a stationary fastening region outside the cushion. The cushion is an elastically resilient object, past which the web of material slides. In some cases this may lead, depending on the friction situation between the web of material and the cushion to stick-and-slip effects and to vibration-like carry-along effects at the cushion.

In order to avoid this and also provide more freedom in the choice of the cushion material and the cushion design, a stationary sliding foil which intercepts the carry-along forces produced by the motion of the web of material and sees to it that the cushion has to supply only the contact forces acting perpendicular to the sliding surface is advantageous.

A preferred field of application of the present invention is the dyeing of rugs. The rug webs have in many cases a woven back, to which the nap is attached in some manner. For technical reasons in the manufacture of rugs, the position of the nap region relative to the backing material cannot be fixed accurately. While the nap region has a substantially constant width, the backing protrudes at both edges and the nap region is displaced laterally in an irregular manner so that the edges become narrower and wider.

The length and position of the slot must now agree, as far as possible, with the length and position of the nap region because, otherwise, treatment medium emerges uncontrollably if at times coverage of the slot by the nap region does not take place. This also causes the pressure of the treatment medium in the slot to break down.

In order to adapt the device to different nap widths as they can occur in different lots of rug webs and, on the other hand, to take into consideration the lateral displacement of the nap region, the application beam can be moved, under control, transversely to the web of material. Adjustable bulkheads, filling the slot and chamber cross section, are provided in the slot in the region of the edges of the web of material. Alternatively, the application beam can be moved, under control, transversely to the web of material, and shaped pieces which fill the slot and the chamber completely are provided in the slot in the region of the edges of the web of material.

The exit width of the slot is limited to the required area by the transverse bulkheads or shaped pieces. Due to the mobility of the application beam overall, which is conventional, e.g., see DE-OS No. 31 27 469, adaptation to different lateral positions of the nap region is possible.

The uniform feeding of the chamber or the slot with treatment medium is of importance particularly for foam treatment medium. In this connection it is common practice to let several feed lines open into the chamber.

It has been found, however, that the uniformity can be increased further if the feed lines for the treatment medium lead perpendicularly to the slot into the chamber. Thereby, a redirection of the treatment medium between the feed and the emergence from the slot is necessary which results in a more uniform distribution of the treatment medium in the slot.

A further embodiment in which at least two foam mixers which can be connected selectably to a foam distributor supplying several foam feed lines uniformly are provided makes possible rapid changes of the treatment medium, for instance, rapid color changes in dyeing. The foam mixers each provide different foams which are fed to one and the same foam distributor which is permanently connected via several leads to the application beam. The foam distributor is a device which distributes an amount of foam which is fed in as uniformly as possible over several outlets which are in communication with the feed lines. For this purpose, for instance, the device described in DE-OS No. 31 31 545 where the foam is distributed to the foam outlets arranged at the circumference of a chamber by a rotor can be considered. Tests have shown that with switching from one foam mixer to the other, a perfect color change can be brought about in rug dyeing in only 10 seconds.

DETAILED DESCRIPTION

Figures 1, 2:
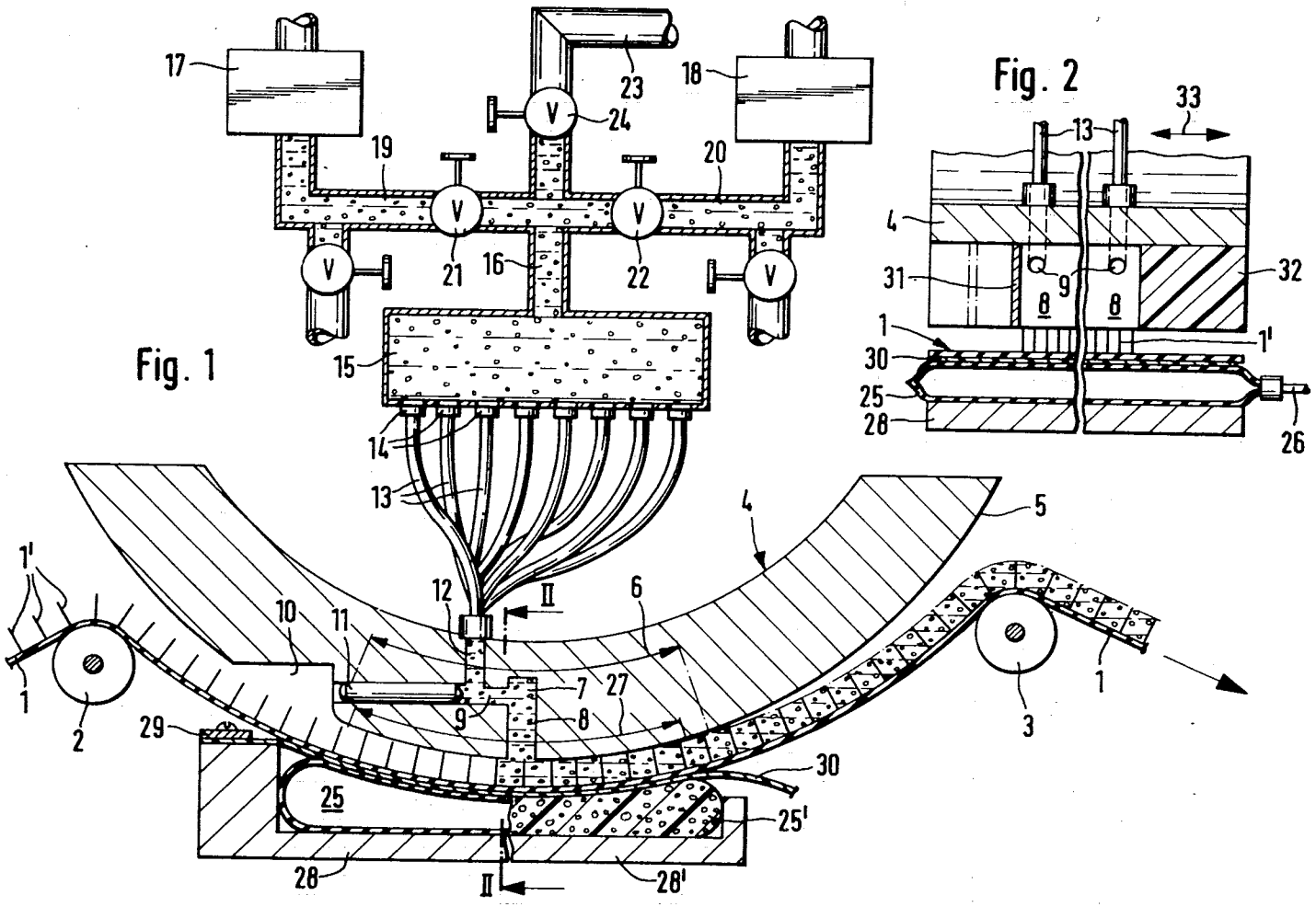
FIG. 1 is a sectional view parallel to the travel direction of the web and perpendicular to the web.
FIG. 2 is a partial cross section according to the line II—II in FIG. 1.

In the embodiments of FIGS. 1 and 2, the web of material 1 is a rug web which is conducted in the manner shown in FIG. 1, with its nap 1' up, over mutually parallel guide rolls 2 and 3 arranged approximately at the same height.

Between the guide rolls 2 and 3 an application beam 4 rests from the top against the web of material; on its side facing the web of material 1, beam 4 forms a sliding surface 5 which has a convex shape, i.e., it is a section of a circular cylinder, since the application beam 4 consists of a segment of a thick-walled tube which was obtained by removing a longitudinal section.

The web of material 1 rests against the sliding surface in the looping region indicated approximately by the arrow 6. Approximately in the middle of the looping region 6 a slot 8, which forms an inner chamber 7, extends approximately perpendicular to the sliding surface and covers the length of the application beam 4, is provided in the application beam 4.

Near the bottom end opening into the slot 8 are feed canals 9 which extend perpendicular thereto and of which quite a number, for instance, 20 or 50, are distributed over the length of the slot 8. The feed canals 9 are formed by transverse holes which are made in the sliding surface 5 starting from a step 10 in the sliding surface 5. The holes are closed off toward the outside by plugs 11. Each individual feed canal 9 is connected to a connecting canal 12 which leads approximately radially to the concave inside of the application beam 4 and is connected there to one of the feed lines 13 which leads to the foam outlets 14 of a distributor 15 which insures that the total mass of foam fed in at a connecting line 16 is distributed uniformly over the foam outlets 14. In the illustrated embodiment, two foam mixers 17 and 18 are assigned to the distributor. These are connected to the connecting line 16 via lines 19 and 20, in which valves 21 and 22 are arranged. by selective operation of the valves 21 and 22, either the foam from the foam mixer 17 or the foam from the foam mixer 18 can be fed to the distributor 15. Rinsing water can be fed in, if required, through the line 23 and the valve 24, for instance, after the work is completed.

In operation of the device, the foam is fed in via feed lines 13, the connecting canals 12 and the feed canals 8 to the slot 8 at points distributed over the length of the slot. The feed is at a right angle to the slot 8, so that the foam is deflected before it can emerge from the slot into the web of material 1, and is thereby made more uniform.

Under the slot 8, a cushion 25 or 25' which presses the web of material 1 against the sliding surface 5 with gentle pressure is arranged on the back of the web of material 1.

In the embodiment shown in FIG. 1 to the left, and in FIG. 2, the cushion 25 consists of an elastic hollow body which can be inflated via connection 26 at a selectable pressure and presses the web of material 1 against the sliding surface 5 in an area 27 which is smaller than the looping region 6, but much wider than the mouth of the slot 8. In a practical embodiment, the slot 8 is 6 mm wide in the travel direction of the web 6, but the contact area 27 is 100 to 200 mm wide.

Instead of the inflatable hollow cushion 25 a foam material cushion 25' may also be provided, as indicated in the right half of FIG. 1.

The cushion 25 or 25' extends over the entire width of the web of material and seals the slot 8 on both sides in the travel direction of the web of material 1 as well as at both edges of the web of material 1. The cushion 25 is held in a stationary support 28, while the support 28' for the cushion 25' must be settable vertically, against the application beam 4 by a small amount in order to bring about the correct pressure of the cushion 25'.

Between the cushion 25 or 25' and the back of the web of material 1, a sliding foil 30 which extends over the entire contact area of the cushion 25 or 25' is arranged. The edge of foil 30 which is backward with respect to the travel direction of the web of material 1 is secured at the support 28 or 28' by means of the strip 29. The fastening is therefore accomplished in such a manner that the sliding foil 30 is stressed in tension by the carry-along forces produced by the friction of the back of the web of material 1 when it slides past the cushion 25 or 25', and the carry-along forces are intercepted by the sliding foil 30 and are kept away from the cushions 25 or 25' in this manner, so that the cushion 25 or 25' need supply only pure contact pressure forces.

In FIG. 2, the design at the edges of the web of material or the ends of the slot 8 is shown. The exit width of the slot must be limited to the width of the nap of the web of material 1. This can be accomplished by changing the bulkheads 31 which fill the cross section of the slot 8 to a different position along the slot 8 as is indicated with dashed lines on the left-hand side in FIG. 2. Should the nap area of a web of material 1 be so narrow that one or the other transverse canal 9 comes to lie outside the bulkhead 31 set to the edge of the nap area, the corresponding feed line 13 must, of course, be shut down.

Another way of limiting the length of the slot 8 is shown on the right-hand side of FIG. 2. Shown here is a shaped piece which fills the cross section of the slot 8 and extends all the way to its end. The pieces form the outer boundary of the slot 8 and at the same time cover up transverse canals 9 which might lie outside.

If the nap area of the web of material 1 moves laterally, the entire application beam 4 is carried along, controlled, in its longitudinal direction, i.e., transversely to the web of material, in the manner indicated by the arrow 33.

What is claimed is:

1. In a device for applying a treatment medium to a running web of material comprising a stationary application beam which extends transversely to the web of material and parallel to its surface, said beam resting with a sliding surface against the surface of the web of material directly in contact therewith and containing an inner chamber extended over its length; feed lines for the treatment medium leading into said chamber; a slot extending along the application beam, opening into the sliding surface; and a support arranged opposite the slot on the other side of the web of material for supporting the web of material travelling past the slot, the improvement comprising: the sliding surface having a convex shape; the support formed by a cushion with a closed surface which extends over the length and width of the slot; said cushion covering the edge of the slot; said cushion elastically resilient at least perpendicular to the sliding surface but support to be stationary overall; said cushion pressing the web of material against the sliding surface in the vicinity of the slot; and said web of material looped under the application beam on a looping angle such that the contact area of the web of material at the convex sliding surface is at least as large as the contact area of the cushion at the web of material.

2. The device according to claim 1, wherein said cushion comprises a hollow body filled with a pressurized fluid.

3. The device according to claim 1, wherein said cushion comprises elastically resilient foam material.

4. The device according to claim 2 wherein said application beam comprises a segment of a thick-walled tube.

5. The device according to claim 3 wherein said application beam comprises a segment of a thick-walled tube.

6. The device according to claim 1 wherein said application beam comprises a segment of a thick-walled tube.

7. The device according to claim 6 and further including a sliding foil arranged between the cushion and the web of material, said foil covering the entire contact area of the cushion at the web of material, said foil having a closed surface; and means holding said foil at its rear edge, relative to the direction of motion of the web of material, at a stationary fastening region outside the cushion.

8. The device according to claim 1 and further including a sliding foil arranged between the cushion and the web of material, said foil covering the entire contact area of the cushion at the web of material, said foil having a closed surface; and means holding said foil at its rear edge, relative to the direction of motion of the web of material, at a stationary fastening region outside the cushion.

9. The device according to claim 2 and further including a sliding foil arranged between the cushion and the web of material, said foil covering the entire contact area of the cushion at the web of material, said foil having a closed surface; and means holding said foil at its rear edge, relative to the direction of motion of the web of material, at a stationary fastening region outside the cushion.

10. The device according to claim 4 and further including a sliding foil arranged between the cushion and the web of material, said foil covering the entire contact area of the cushion at the web of material, said foil having a closed surface; and means holding said foil at its rear edge, relative to the direction of motion of the web of material, at a stationary fastening region outside the cushion.

11. The device according to claim 5 and further including a sliding foil arranged between the cushion and the web of material, said foil covering the entire contact area of the cushion at the web of material, said foil having a closed surface; and means holding said foil at its rear edge, relative to the direction of motion of the web of material, at a stationary fastening region outside the cushion.

12. The device according to claim 7, wherein said application beam can be moved, under control, transversely to the web of material, and further including adjustable bulkheads filling the slot and chamber cross section, disposed in the slot in the region of the edges of the web of material.

13. The device according to claim 1, wherein said application beam can be moved, under control, transversely to the web of material, and further including adjustable bulkheads filling the slot and chamber cross section, disposed in the slot in the region of the edges of the web of material.

14. The device according to claim 2, wherein said application beam can be moved, under control, transversely to the web of material, and further including adjustable bulkheads filling the slot and chamber cross section, disposed in the slot in the region of the edges of the web of material.

15. The device according to claim 4, wherein said application beam can be moved, under control, transversely to the web of material, and further including adjustable bulkheads filling the slot and chamber cross section, disposed in the slot in the region of the edges of the web of material.

16. The device according to claim 5, wherein said application beam can be moved, under control, transversely to the web of material, and further including adjustable bulkheads filling the slot and chamber cross section, disposed in the slot in the region of the edges of the web of material.

17. The device according to claim 12, wherein the application beam can be moved, under control, transversely to the web of material, and further including shaped pieces which fill the slot and the chamber completely disposed in the slot in the region of the edges of the web of material.

18. The device according to claim 1, wherein the application beam can be moved, under control, tranversely to the web of material, and further including shaped pieces which fill the slot and the chamber completely disposed in the slot in the region of the edges of the web of material.

19. The device according to claim 4, wherein the application beam can be moved, under control, transversely to the web of material, and further including shaped pieces which fill the slot and the chamber completely disposed in the slot in the region of the edges of the web of material.

20. The device according to claim 5, wherein the application beam can be moved, under control, transversely to the web of material, and further including shaped pieces which fill the slot and the chamber completely disposed in the slot in the region of the edges of the web of material.

21. The device according to claim 7, wherein the application beam can be moved, under control, transversely to the web of material, and further including shaped pieces which fill the slot and the chamber completely disposed in the slot in the region of the edges of the web of material.

22. The device according to claim 17, wherein feed lines for the treatment medium are provided distributed over the length of the chamber and said feed lines lead into the chamber perpendicular to the slot.

23. The device according to claim 1, wherein feed lines for the treatment medium are provided distributed over the length of the chamber and said feed lines lead into the chamber perpendicular to the slot.

24. The device according to claim 4, wherein feed lines for the treatment medium are provided distributed over the length of the chamber and said feed lines lead into the chamber perpendicular to the slot.

25. The device according to claim 5, wherein feed lines for the treatment medium are provided distributed over the length of the chamber and said feed lines lead into the chamber perpendicular to the slot.

26. The device according to claim 7, wherein feed lines for the treatment medium are provided distributed over the length of the chamber and said feed lines lead into the chamber perpendicular to the slot.

27. The device according to claim 26, for the application of foam, and further including a foam distributor and, at least two foam mixers which can be connected selectably to said foam distributor, each foam distributor uniformly supplying several foam feed lines.

28. The device according to claim 1, for the application of foam, and further including a foam distributor and at least two foam mixers which can be connected selectably to said foam distributor, each foam distributor uniformly supplying several foam feed lines.

29. The device according to claim 4, for the application of foam, and further including a foam distributor and at least two foam mixers which can be connected selectably to said foam distributor, each foam distributor uniformly supplying several foam feed lines.

30. The device according to claim 5, for the application of foam, and further including a foam distributor and at least two foam mixers which can be connected selectably to said foam distributor, each foam distributor uniformly supplying several foam feed lines.

31. The device according to claim 7, for the application of foam, and further including a foam distributor and at least two foam mixers which can be connected selectably to said foam distributor, each foam distributor uniformly supplying several foam feed lines.

32. The device according to claim 12, for the application of foam, and further including a foam distributor and at least two foam mixers which can be connected selectably to said foam distributor, each foam distributor uniformly supplying several foam feed lines.

33. The device according to claim 19, for the application of foam, and further including a foam distributor and at least two foam mixers which can be connected selectably to said foam distributor, each foam distributor uniformly supplying several foam feed lines.

* * * * *